US010512834B2

(12) United States Patent
Joshi et al.

(10) Patent No.: US 10,512,834 B2
(45) Date of Patent: Dec. 24, 2019

(54) BUSINESS STRATEGY GAME

(71) Applicants: Maheshkumar P. Joshi, Potomac, MD (US); Tej M. Joshi, Potomac, MD (US); Swati Choksi, Potomac, MD (US)

(72) Inventors: Maheshkumar P. Joshi, Potomac, MD (US); Tej M. Joshi, Potomac, MD (US); Swati Choksi, Potomac, MD (US)

( * ) Notice: Subject to any disclaimer, the term of this patent is extended or adjusted under 35 U.S.C. 154(b) by 0 days.

(21) Appl. No.: 15/454,082

(22) Filed: Mar. 9, 2017

(65) Prior Publication Data

US 2019/0091557 A1 Mar. 28, 2019

Related U.S. Application Data

(60) Provisional application No. 62/305,796, filed on Mar. 9, 2016.

(51) Int. Cl.

| | |
|---|---|
| ***A63F 1/00*** | (2006.01) |
| ***A63F 3/00*** | (2006.01) |
| ***A63F 1/04*** | (2006.01) |
| *A63F 11/00* | (2006.01) |

(52) U.S. Cl.

CPC ..... *A63F 3/00063* (2013.01); *A63F 1/00* (2013.01); *A63F 1/04* (2013.01); *A63F 3/00* (2013.01); *A63F 3/00069* (2013.01); *A63F 2001/0441* (2013.01); *A63F 2011/0058* (2013.01); *A63F 2011/0067* (2013.01)

(58) Field of Classification Search

CPC ..... A63F 3/00063; A63F 3/00069; A63F 3/00072; A63F 3/00; A63F 2011/0058; A63F 2011/0067; A63F 1/00

USPC ..... 273/256, 297, 302, 308

See application file for complete search history.

(56) References Cited

U.S. PATENT DOCUMENTS

| | | | | |
|---|---|---|---|---|
| 4,289,313 A * | 9/1981 | Delamontagne .... | A63F 3/00063 | 273/256 |
| 4,354,684 A * | 10/1982 | McKinley ..... | A63F 3/00072 | 273/249 |
| 4,501,425 A * | 2/1985 | Alvarado ..... | A63F 3/00072 | 273/249 |

(Continued)

*Primary Examiner* — Benjamin Layno

(74) *Attorney, Agent, or Firm* — Raj S. Dave; Dave Law Group LLC

(57) ABSTRACT

Present invention, "BiggieBills", is an interactive business strategy multi-player game played among 4 to 8 teams using plurality of cards. It can be played "Face to Face" or "Online." The teams play "Growth Cards" to progress from Stage 1 to 4 while managing possible "Challenge Cards" played by opposing teams, managing the random changes in "Industry Rules" every "Business Cycle," and attempt to earn "Bonus Cards." The unique value propositions are: a) dynamic real-time experience; b) knowledge from the field of strategic management for the managers (students); c) the debrief provides the core learning as a follow-up to the game; and d) customization of the game is possible by altering industry conditions to suit client needs. BiggieBills has a three-pronged approach: a) corporate training; b) education (undergraduate, graduate, executive); and c) entertainment. It may be redesigned to teach subjects such as entrepreneurship, economics, innovation management and general business.

2 Claims, 34 Drawing Sheets

Stage 1, Six Unique Growth cards

(56) References Cited

U.S. PATENT DOCUMENTS

| | | | | |
|---|---|---|---|---|
| 5,788,235 | A * | 8/1998 | Thomas | A63F 3/00072 273/256 |
| 6,142,472 | A * | 11/2000 | Kliebisch | A63F 3/04 273/236 |
| 6,237,915 | B1 * | 5/2001 | Ledet | A63F 3/00063 273/236 |
| 2006/0202417 | A1 * | 9/2006 | DeLaCruz-Newlan | A63F 3/02 273/242 |
| 2011/0190040 | A1 * | 8/2011 | Cogliano | A63F 9/24 463/9 |

* cited by examiner

FIG.1

Stage 1, Six Unique Growth cards

VENDOR MANAGEMENT
STAGE 1- PROCESS 1

To improve this process resources needed:
- $ 3 million

Payoff (if unchallenged)
- $ 6 million (if first team)
- $ 4 million (if second or later)

Loss (if growth card challenged)
- Pay $ 4 million to each team that challenges your growth card
- If challenged you lose your initial investment

SUPPLY CHAIN
STAGE 1- PROCESS 2

To improve this process resources needed:
- $ 3 million

Payoff (if unchallenged)
- $ 7 million (if first team)
- $ 5 million (if second or later)

Loss (if growth card challenged)
- Pay $ 5 million to each team that challenges your growth card
- If challenged you lose your initial investment

INVENTORY MANAGEMENT
STAGE 1- PROCESS 3

To improve this process resources needed:
- $ 3 million

Payoff (if unchallenged)
- $ 8 million (if first team)
- $ 6 million (if second or later)

Loss (if growth card challenged)
- Pay $ 6 million to each team that challenges your growth card
- If challenged you lose your initial investment

VENDOR MANAGEMENT
STAGE 1- PROCESS 4

To improve this process resources needed:
- $ 5 million

Payoff (if unchallenged)
- $ 13 million (if first team)
- $ 10 million (if second or later)

Loss (if growth card challenged)
- Pay $ 10 million to each team that challenges your growth card
- If challenged you lose your initial investment

SUPPLY CHAIN
STAGE 1- PROCESS 5

To improve this process resources needed:
- $ 5 million

Payoff (if unchallenged)
- $ 14 million (if first team)
- $ 11 million (if second or later)

Loss (if growth card challenged)
- Pay $ 11 million to each team that challenges your growth card
- If challenged you lose your initial investment

INVENTORY MANAGEMENT
STAGE 1- PROCESS 6

To improve this process resources needed:
- $ 5 million

Payoff (if unchallenged)
- $ 15 million (if first team)
- $ 12 million (if second or later)

Loss (if growth card challenged)
- Pay $ 12 million to each team that challenges your growth card
- If challenged you lose your initial investment

FIG.2

Stage 2, Six Unique Growth cards

ACCOUNTING SYSTEM
STAGE 2- SYSTEM 1

To improve this system resources needed:
- $ 10 million

Payoff (if unchallenged)
- $ 20 million (if first team)
- $ 15 million (if second or later)

Loss (if growth card challenged)
- Pay $ 15 million to each team that challenges your growth card
- If challenged by a team you lose your initial investment

IT SYSTEM
STAGE 2- SYSTEM 2

To improve this system resources needed:
- $ 10 million

Payoff (if unchallenged)
- $ 22 million (if first team)
- $ 18 million (if second or later)

Loss (if growth card challenged)
- Pay $ 18 million to each team that challenges your growth card
- If challenged by a team you lose your initial investment

RECRUITING SYSTEM
STAGE 2- SYSTEM 3

To improve this system resources needed:
- $ 10 million

Payoff (if unchallenged)
- $ 23 million (if first team)
- $ 20 million (if second or later)

Loss (if growth card challenged)
- Pay $ 20 million to each team that challenges your growth card
- If challenged by a teamyou lose your initial investment

TRAINING SYSTEM
STAGE 2- SYSTEM 4

To improve this system resources needed:
- $ 15 million

Payoff (if unchallenged)
- $ 28 million (if first team)
- $ 22 million (if second or later)

Loss (if growth card challenged)
- Pay $ 22 million to each team that challenges your growth card
- If challenged by a teamyou lose your initial investment

REWARD SYSTEM
STAGE 2- SYSTEM 5

To improve this system resources needed:
- $ 15 million

Payoff (if unchallenged)
- $ 35 million (if first team)
- $ 30 million (if second or later)

Loss (if growth card challenged)
- Pay $ 30 million to each team that challenges your growth card
- If challenged by a team you lose your initial investment

GOVERNANCE SYSTEM
STAGE 2- SYSTEM 6

To improve this system resources needed:
- $ 15 million

Payoff (if unchallenged)
- $ 38 million (if first team)
- $ 33 million (if second or later)

Loss (if growth card challenged)
- Pay $ 33 million to each team that challenges your growth card
- If challenged by a teamyou lose your initial investment

FIG.3

Stage 3, Six Unique Growth cards

MARKETING STRATEGY
STAGE 3- STRATEGY 1

To improve this strategy resources needed:
- $ 20 million

Payoff (if unchallenged)
- $ 40 million (if first team)
- $ 35 million (if second or later)

Loss (if growth card challenged)
- Pay $ 35 million to each team that challenges your growth card
- If challenged you lose your initial investment

OPERATIONS STRATEGY
STAGE 3- STRATEGY 2

To improve this strategy resources needed:
- $ 30 million

Payoff (if unchallenged)
- $ 45 million (if first team)
- $ 37 million (if second or later)

Loss (if growth card challenged)
- Pay $ 37 million to each team that challenges your growth card
- If challenged you lose your initial investment

LOW COST STRATEGY
STAGE 3- STRATEGY 3

To improve this strategy resources needed:
- $ 20 million

Payoff (if unchallenged)
- $ 50 million (if first team)
- $ 42 million (if second or later)

Loss (if growth card challenged)
- Pay $ 42 million to each team that challenges your growth card
- If challenged you lose your initial investment

SOCIAL MEDIA STRATEGY
STAGE 3- STRATEGY 4

To improve this strategy resources needed:
- $ 25 million

Payoff (if unchallenged)
- $ 55 million (if first team)
- $ 50 million (if second or later)

Loss (if growth card challenged)
- Pay $ 50 million to each team that challenges your growth card
- If challenged you lose your initial investment

INNOVATION STRATEGY
STAGE 3- STRATEGY 5

To improve this strategy resources needed:
- $ 25 million

Payoff (if unchallenged)
- $ 60 million (if first team)
- $ 55 million (if second or later)

Loss (if growth card challenged)
- Pay $ 55 million to each team that challenges your growth card
- If challenged you lose your initial investment

DIFFERENTIATION STRATEGY
STAGE 3- STRATEGY 6

To improve this strategy resources needed:
- $ 25 million

Payoff (if unchallenged)
- $ 65 million (if first team)
- $ 60 million (if second or later)

Loss (if growth card challenged)
- Pay $ 60 million to each team that challenges your growth card
- If challenged you lose your initial investment

FIG.4

Stage 4, Six Unique Growth cards

VERTICAL INTEGRATION
STAGE 4 - CORPORATE STRATEGY 1

To implement this strategy resources needed:
- $ 40 million

Payoff (if unchallenged)
- $ 80 million (if first team)
- $ 75 million (if second or later)

Loss (if growth card challenged)
- Pay $ 75 million to each team that challenges your growth card
- If challenged you lose your initial investment

STRATEGIC ALLIANCE
STAGE 4 - CORPORATE STRATEGY 2

To implement this strategy resources needed:
- $ 40 million

Payoff (if unchallenged)
- $ 90 million (if first team)
- $ 85 million (if second or later)

Loss (if growth card challenged)
- Pay $ 85 million to each team that challenges your growth card
- If challenged you lose your initial investment

GLOBAL STRATEGY
STAGE 4 - CORPORATE STRATEGY 3

To implement this strategy resources needed:
- $ 40 million

Payoff (if unchallenged)
- $ 100 million (if first team)
- $ 95 million (if second or later)

Loss (if growth card challenged)
- Pay $ 95 million to each team that challenges your growth card
- If challenged you lose your initial investment

DIVERSIFICATION
STAGE 4 - CORPORATE STRATEGY 4

To implement this strategy resources needed:
- $ 50 million

Payoff (if unchallenged)
- $ 110 million (if first team)
- $ 105 million (if second or later)

Loss (if growth card challenged)
- Pay $ 105 million to each team that challenges your growth card
- If challenged you lose your initial investment

WHITE CANVAS
STAGE 4 - CORPORATE STRATEGY 5

To implement this strategy resources needed:
- $ 50 million

Payoff (if unchallenged)
- $ 120 million (if first team)
- $ 115 million (if second or later)

Loss (if growth card challenged)
- Pay $ 115 million to each team that challenges your growth card
- If challenged you lose your initial investment

ACQUIRE A COMPUTER
STAGE 4 - CORPORATE STRATEGY 6

To implement this strategy resources needed:
- $ 50 million

Payoff (if unchallenged)
- $ 150 million (if first team)
- $ 125 million (if second or later)

Loss (if growth card challenged)
- Pay $ 125 million to each team that challenges your growth card
- If challenged you lose your initial investment

FIG.5

Stage 1, Six Unique Growth cards

| | | |
|---|---|---|
| **Challenge Vendor Management**<br>**To Challenge Process 1 Stage 1**<br>• To initiate this challenge your team must have successfully played a Growth card in this Stage<br>• To be a follower ( second team) Challenger, no stage completion is required<br>• Each challenging team receives $ 5 million | **Challenge Supply Chain Management**<br>**To Challenge Process 2 Stage 1**<br>• To initiate this challenge your team must have successfully played a Growth card in this Stage<br>• To be a follower ( second team) Challenger, no stage completion is required<br>• Each challenging team receives $ 6 million | **Challenge Inventory Management**<br>**To Challenge Process 3 Stage 1**<br>• To initiate this challenge your team must have successfully played a Growth card in this Stage<br>• To be a follower ( second team) Challenger, no stage completion is required<br>• Each challenging team receives $ 4 million |
| **Challenge Custom Relations**<br>**To Challenge Process 1 Stage 1**<br>• To initiate this challenge your team must have successfully played a Growth card in this Stage<br>• To be a follower ( second team) Challenger, no stage completion is required<br>• Each challenging team receives $ 10 million | **Challenge Communications**<br>**To Challenge Process 2 Stage 1**<br>• To initiate this challenge your team must have successfully played a Growth card in this Stage<br>• To be a follower ( second team) Challenger, no stage completion is required<br>• Each challenging team receives $ 11 million | **Challenge Financial Management**<br>**To Challenge Process 3 Stage 1**<br>• To initiate this challenge your team must have successfully played a Growth card in this Stage<br>• To be a follower ( second team) Challenger, no stage completion is required<br>• Each challenging team receives $ 12 million |

FIG.6

Stage 2, Six Unique Growth cards

Challenge Accounting System

To Challenge System1 Stage 2

- To initiate this challenge your team must have successfully played a Growth card in this Stage
- To be a follower ( second team) Challenger, no stage completion is required
- Each challenging team receives $ 15 million

Challenge IT System

To Challenge System 2 Stage 2

- To initiate this challenge your team must have successfully played a Growth card in this Stage
- To be a follower ( second team) Challenger, no stage completion is required
- Each challenging team receives $ 18 million

Challenge Recruiting System

To Challenge System 3 Stage 2

- To initiate this challenge your team must have successfully played a Growth card in this Stage
- To be a follower ( second team) Challenger, no stage completion is required
- Each challenging team receives $ 20 million

Challenge Training System

To Challenge System 4 Stage 2

- To initiate this challenge your team must have successfully played a Growth card in this Stage
- To be a follower ( second team) Challenger, no stage completion is required
- Each challenging team receives $ 22 million

Challenge Reward System

To Challenge System 5 Stage 2

- To initiate this challenge your team must have successfully played a Growth card in this Stage
- To be a follower ( second team) Challenger, no stage completion is required
- Each challenging team receives $ 30 million

Challenge Governance System

To Challenge System 6 Stage 2

- To initiate this challenge your team must have successfully played a Growth card in this Stage
- To be a follower ( second team) Challenger, no stage completion is required
- Each challenging team receives $ 33 million

FIG.7

Stage 3, Six Unique Growth cards

| | | |
|---|---|---|
| **Challenge Marketing Strategy**<br>**To Challenge Strategy 1 Stage 3**<br>• To initiate this challenge your team must have successfully played a Growth card in this Stage<br>• To be a follower ( second team) Challenger, no stage completion is required<br>• Each challenging team receives $ 35 million | **Challenge Operation Strategy**<br>**To Challenge Strategy 2 Stage 3**<br>• To initiate this challenge your team must have successfully played a Growth card in this Stage<br>• To be a follower ( second team) Challenger, no stage completion is required<br>• Each challenging team receives $ 37 million | **Challenge Low Cost Strategy**<br>**To Challenge Strategy 3 Stage 3**<br>• To initiate this challenge your team must have successfully played a Growth card in this Stage<br>• To be a follower ( second team) Challenger, no stage completion is required<br>• Each challenging team receives $ 42 million |
| **Challenge Social Media Strategy**<br>**To Challenge Strategy 4 Stage 3**<br>• To initiate this challenge your team must have successfully played a Growth card in this Stage<br>• To be a follower ( second team) Challenger, no stage completion is required<br>• Each challenging team receives $ 50 million | **Challenge Innovation Strategy**<br>**To Challenge Strategy 5 Stage 3**<br>• To initiate this challenge your team must have successfully played a Growth card in this Stage<br>• To be a follower ( second team) Challenger, no stage completion is required<br>• Each challenging team receives $ 55 million | **Challenge Differentiation Strategy**<br>**To Challenge Strategy 6 Stage 3**<br>• To initiate this challenge your team must have successfully played a Growth card in this Stage<br>• To be a follower ( second team) Challenger, no stage completion is required<br>• Each challenging team receives $ 60 million |

FIG.8

Stage 4, Six Unique Growth cards

| | | |
|---|---|---|
| **Challenge Vertical Integration**<br>**To Challenge Corporate Strategy 1 Stage 4**<br>• To initiate this challenge your team must have successfully played a Growth card in this Stage<br>• To be a follower ( second team) Challenger, no stage completion is required<br>• Each challenging team receives $ 75 million | **Challenge Strategic Alliances**<br>**To Challenge Corporate Strategy 2 Stage 4**<br>• To initiate this challenge your team must have successfully played a Growth card in this Stage<br>• To be a follower ( second team) Challenger, no stage completion is required<br>• Each challenging team receives $ 85 million | **Challenge Global Strategy**<br>**To Challenge Corporate Strategy 3 Stage 4**<br>• To initiate this challenge your team must have successfully played a Growth card in this Stage<br>• To be a follower ( second team) Challenger, no stage completion is required<br>• Each challenging team receives $ 95 million |
| **Challenge Diversification**<br>**To Challenge Corporate Strategy 4 Stage 4**<br>• To initiate this challenge your team must have successfully played a Growth card in this Stage<br>• To be a follower ( second team) Challenger, no stage completion is required<br>• Each challenging team receives $ 50 million | **Challenge White Canvas**<br>**To Challenge Corporate Strategy 5 Stage 4**<br>• To initiate this challenge your team must have successfully played a Growth card in this Stage<br>• To be a follower ( second team) Challenger, no stage completion is required<br>• Each challenging team receives $ 115 million | **Challenge Acquisition of a Team**<br>**To Challenge Corporate Strategy 6 Stage 4**<br>• To initiate this challenge your team must have successfully played a Growth card in this Stage<br>• To be a follower ( second team) Challenger, no stage completion is required<br>• Each challenging team receives $ 125 million |

FIG.9

Bonus cards (Flexible Challenge Bonus cards)

| | | |
|---|---|---|
| **BONUS CHALLENGE**<br>**FLEXIBLE CHALLENGE CARD**<br>POSSESSION OF THIS CARD ALLOWS YOU TO CHALLENGE ANY GROWTH CARDS IN **ONLY STAGE 1 OR STAGE 2**<br>Rest of the challenge card rules **DO NOT APPLY** - you can use this card even if you have not completed this stage | **BONUS CHALLENGE**<br>**FLEXIBLE CHALLENGE CARD**<br>POSSESSION OF THIS CARD ALLOWS YOU TO CHALLENGE ANY GROWTH CARDS IN **ONLY STAGE 1 OR STAGE 2**<br>Rest of the challenge card rules **DO NOT APPLY** - you can use this card even if you have not completed this stage | **BONUS CHALLENGE**<br>**FLEXIBLE CHALLENGE CARD**<br>POSSESSION OF THIS CARD ALLOWS YOU TO CHALLENGE ANY GROWTH CARDS IN **ONLY STAGE 1 OR STAGE 2**<br>Rest of the challenge card rules **DO NOT APPLY** - you can use this card even if you have not completed this stage |
| **BONUS CHALLENGE**<br>**FLEXIBLE CHALLENGE CARD**<br>POSSESSION OF THIS CARD ALLOWS YOU TO CHALLENGE ANY GROWTH CARDS IN **ONLY STAGE 3 OR STAGE 4**<br>Rest of the challenge card rules **DO NOT APPLY** - you can use this card even if you have not completed this stage | **BONUS CHALLENGE**<br>**FLEXIBLE CHALLENGE CARD**<br>POSSESSION OF THIS CARD ALLOWS YOU TO CHALLENGE ANY GROWTH CARDS IN **ONLY STAGE 3 OR STAGE 4**<br>Rest of the challenge card rules **DO NOT APPLY** - you can use this card even if you have not completed this stage | **BONUS CHALLENGE**<br>**FLEXIBLE CHALLENGE CARD**<br>POSSESSION OF THIS CARD ALLOWS YOU TO CHALLENGE ANY GROWTH CARDS IN **ONLY STAGE 3 OR STAGE 4**<br>Rest of the challenge card rules **DO NOT APPLY** - you can use this card even if you have not completed this stage |

FIG.10

Bonus Cards (Block A Challenge Bonus Cards)

BONUS
BLOCK A CHALLENGE CARD

POSSESSION OF THIS CARD ALLOWS YOU TO BLOCK A CHALLENGE IMPOSED UPON YOU BY A COMPETITING TEAM ON A GROWTH CARD PLAYED BY YOU

WHEN TO USE THIS CARD

- This card must be used immediately when your growth card is Challenged by another team - do not wait for your turn
- The benefit of this card is that your growth card remains active and no losses are accrued

BONUS
BLOCK A CHALLENGE CARD

POSSESSION OF THIS CARD ALLOWS YOU TO BLOCK A CHALLENGE IMPOSED UPON YOU BY A COMPETITING TEAM ON A GROWTH CARD PLAYED BY YOU

WHEN TO USE THIS CARD

- This card must be used immediately when your growth card is Challenged by another team - do not wait for your turn
- The benefit of this card is that your growth card remains active and no losses are accrued

BONUS
BLOCK A CHALLENGE CARD

POSSESSION OF THIS CARD ALLOWS YOU TO BLOCK A CHALLENGE IMPOSED UPON YOU BY A COMPETITING TEAM ON A GROWTH CARD PLAYED BY YOU

WHEN TO USE THIS CARD

- This card must be used immediately when your growth card is Challenged by another team - do not wait for your turn
- The benefit of this card is that your growth card remains active and no losses are accrued

BONUS
BLOCK A CHALLENGE CARD

POSSESSION OF THIS CARD ALLOWS YOU TO BLOCK A CHALLENGE IMPOSED UPON YOU BY A COMPETITING TEAM ON A GROWTH CARD PLAYED BY YOU

WHEN TO USE THIS CARD

- This card must be used immediately when your growth card is Challenged by another team - do not wait for your turn
- The benefit of this card is that your growth card remains active and no losses are accrued

BONUS
BLOCK A CHALLENGE CARD

POSSESSION OF THIS CARD ALLOWS YOU TO BLOCK A CHALLENGE IMPOSED UPON YOU BY A COMPETITING TEAM ON A GROWTH CARD PLAYED BY YOU

WHEN TO USE THIS CARD

- This card must be used immediately when your growth card is Challenged by another team - do not wait for your turn
- The benefit of this card is that your growth card remains active and no losses are accrued

BONUS
BLOCK A CHALLENGE CARD

POSSESSION OF THIS CARD ALLOWS YOU TO BLOCK A CHALLENGE IMPOSED UPON YOU BY A COMPETITING TEAM ON A GROWTH CARD PLAYED BY YOU

WHEN TO USE THIS CARD

- This card must be used immediately when your growth card is Challenged by another team - do not wait for your turn
- The benefit of this card is that your growth card remains active and no losses are accrued

FIG.11

Industry (Conditions) Rules Change Cards 1 through 6

Industry Conditions 1

Consequences of Actions: You gain a bonus of $ 10 million for each of the following completed growth cards (or if you complete during the current business cycle)

- Vendor Management
- Supply Chain Management
- Operations Strategy

This Business cycle:
You may play two Growth Cards or one growth and one challenge card during your turn in this business cycle

Industry Conditions 2

Consequences of Actions: You gain a bonus of $ 10 million for each of the following completed growth cards (or if you complete during the current business cycle)

- Communications Management
- Training Systems
- Reward Systems

This Business cycle:
Payoff on any completed Growth card is doubled in this business cycle (the loss doubles when the Growth card is Challenged)

Industry Conditions 3

Consequences of Actions: You gain a bonus of $ 18 million for each of the following completed growth cards Or you will be eligible for the bonus if you successfully complete these growth card during the current business cycle

- Financial Management
- Accounting Systems
- Governance Systems

Industry Conditions 4

Consequences of Actions: You lose $ 10 million if you have not currently completed any of the following growth card

- Vendor Management
- Supply Chain Management
- Or Operations Strategy

This Business cycle:
You may play two Growth Cards or one growth and one challenge card during your turn in this business cycle

Industry Conditions 5

Consequences of Actions: You lose $ 12 million if you have not currently completed any of the following growth card

- Communications Management
- Training Systems
- Reward Systems

This Business cycle:
Payoff on any completed Growth card is doubled in this business cycle (the loss doubles when the Growth card is Challenged)t

Industry Conditions 6

Consequences of Actions: You lose $ 18 million if you have not currently completed any of the following growth card. Even if you play these cards successfully in this business cycle your losses are not reversed. To avoid losses you must have already played these cards.

- Financial Management
- Accounting Systems
- Governance Systems

FIG.12

Industry (Conditions) Rules Change Cards 7 through 12

Industry Conditions 7

Consequences of Actions: You gain a bonus of $ 12 million for each of the following completed growth cards (or if you complete during the current business cycle)

- Customer Relationship Management
- Marketing Strategy
- Innovation Strategy

This Business cycle:
You may play two Growth Cards or one growth and one growth card during your turn in this business cycle

Industry Conditions 8

Consequences of Actions: You gain a bonus of $ 15 million for each of the following completed growth cards (or if you complete during the current business cycle)

- Inventory Management
- IT Systems
- Low Cost Strategy

This Business cycle:
Payoff on any completed Growth card is doubled in this business cycle (the loss doubles when the Growth card is Challenged)

Industry Conditions 9

Consequences of Actions: You gain a bonus of $ 18 million for each of the following completed growth cards (or if you complete during the current business cycle)

- RecruitingManagement
- Differentiation Strategy
- White Canvas Strategy

Industry Conditions 10

Consequences of Actions: You lose $ 12 million if you have not currently completed any of the following growth card

- Customer Relationship Management
- Marketing Strategy
- Innovation Strategy

This Business cycle:
You may play two Growth Cards or one growth and one challenge card during your turn in this business cycle

Industry Conditions 11

Consequences of Actions: You lose $ 15 million if you have not currently completed any of the following growth card

- Inventory Management
- IT Systems
- Low Cost Strategy

This Business cycle:
Payoff on any completed Growth card is doubled in this business cycle (the loss doubles when the Growth card is Challenged)

Industry Conditions 12

Consequences of Actions: You lose $ 18 million if you have not currently completed any of the following growth card.

- Recruiting System
- Differentiation Strategy
- White Canvas Strategy

FIG.13

Industry (Conditions) Rules Change Cards 13 through 18

Industry Conditions 13

Consequences of Actions: You gain a bonus of $ 20 million for each of the following completed growth cards (or if you complete during the current business cycle)

- Social Media Strategy
- IT Systems
- Customer Relationship Management

This Business cycle:
You may play two Growth Cards or one growth and one action card during your turn in this business cycle

Industry Conditions 14

Consequences of Actions: You gain a bonus of $ 25 million for each of the following completed growth cards (or if you complete during the current business cycle)

- Vertical Integration
- Accounting System
- Operations Strategy

This Business cycle:
Payoff on any completed Growth card is doubled in this business cycle (the loss doubles when the Growth card is Challenged)

Industry Conditions 15

Consequences of Actions: You gain a bonus of $ 30 million for each of the following completed growth cards (or if you complete during the current business cycle)

- Financial Management
- Strategic Alliance
- Global Strategy

Industry Conditions 16

Consequences of Actions: You lose $ 20 million if you have not currently completed any of the following growth card

- Social Media Strategy
- IT Systems
- Customer Relationship Management

This Business cycle:
You may play two Growth Cards or one growth and one challenge card during your turn in this business cycle

Industry Conditions 17

Consequences of Actions: You lose $ 25 million if you have not currently completed any of the following growth card

- Vertical Integration
- Accounting System
- Operations Strategy

This Business cycle:
Payoff on any completed Growth card is doubled in this business cycle (the loss doubles when the Growth card is Challenged)

Industry Conditions 18

Consequences of Actions: You lose $ 25 million if you have not currently completed any of the following growth card.

- Financial Management
- Strategic Alliance
- Global Strategy

FIG.14

Industry (Conditions) Rules Change Cards 19 through 24

| Industry Conditions 19 | Industry Conditions 20 | Industry Conditions 21 |
|---|---|---|
| **Consequences of Actions:** You gain a bonus of $ 40 million if you have already completed or complete during this business cycle<br>• Four growth cards in Stage 1<br>**This Business cycle:** You may play two Growth Cards or one growth and one challenge card during your turn in this business cycle | **Consequences of Actions:** You gain a bonus of $ 50 million if you have already completed or complete during this business cycle<br>• Four growth cards in Stage 2<br>**This Business cycle:** Payoff on any completed Growth card is doubled in this business cycle (the loss doubles when the Growth card is Challenged) | **Consequences of Actions:** You gain a bonus of $ 60 million if you have already completed or complete during this business cycle<br>• Four growth cards in Stage 3 |
| **Industry Conditions 22** | **Industry Conditions 23** | **Industry Conditions 24** |
| **Consequences of Actions:** You lose $ 40 million for completing<br>Global Strategy in Stage 4<br>**This Business cycle:** You may play two Challenge Cards or one growth and one challenge card during your turn in this business cycle | **Consequences of Actions:** You lose $ 50 million for completing<br>Diversification Strategy in Stage 4<br>**This Business cycle:** Payoff on any completed Growth card is doubled in this business cycle (the loss doubles when the Growth card is Challenged) | **Consequences of Actions:** You lose $ 60 million for completing as this strategy failed<br>White Canvas Strategy in Stage 4 |

Back Side of each Growth cards

Back Side of each Challenge cards

Back Side of each Bonus cards

Back Side of each Industry Conditions cards

Game Board with spaces for Growth Card Deck and industry Card Deck

Game Board with spaces for Challenge Card Deck and Bonus Card Deck

FIG.21

Game Board For Team 1 Activity

BiggieBills$$$ TEAM ONE

| Completed Growth Cards | | | | | | | | | | | | Active Card this Turn |
|---|---|---|---|---|---|---|---|---|---|---|---|---|
| Stage 1 | | | Stage 2 | | | Stage 3 | | | Stage 4 | | | |
| Vendor | Try 1 | Try 2 | Acct Sys | Try 1 | Try 2 | Marketing | Try 1 | Try 2 | Vertical | Try 1 | Try 2 | |
| Supply | Try 1 | Try 2 | IT Sys | Try 1 | Try 2 | Operations | Try 1 | Try 2 | Alliance | Try 1 | Try 2 | |
| Inventory | Try 1 | Try 2 | Recruiting | Try 1 | Try 2 | Low Cost | Try 1 | Try 2 | Global | Try 1 | Try 2 | |
| Customer | Try 1 | Try 2 | Training | Try 1 | Try 2 | Soc Media | Try 1 | Try 2 | Diversify | Try 1 | Try 2 | |
| Communicate | Try 1 | Try 2 | Reward | Try 1 | Try 2 | Innovation | Try 1 | Try 2 | Canvas | Try 1 | Try 2 | |
| Finanacial | Try 1 | Try 2 | Governance | Try 1 | Try 2 | Diff Strat | Try 1 | Try 2 | Acquisition | Try 1 | Try 2 | |
| Bonus 1 | | | Bonus 1 | | | Bonus 1 | | | Bonus 1 | | | |
| Stage 1 | | | Stage 2 | | | Stage 4 | | | Stage 4 | | | |
| Bonus 2 | | | Bonus 2 | | | Bonus 2 | | | Bonus 2 | | | |
| Stage 1 | | | Stage 2 | | | Stage 4 | | | Stage 4 | | | |

FIG.22

Game Board For Team 2 Activity

BiggieBills$$$ TEAM TWO

| Completed Growth Cards | | | | | | | | | | | | Active Card this Turn |
|---|---|---|---|---|---|---|---|---|---|---|---|---|
| Stage 1 | | | Stage 2 | | | Stage 3 | | | Stage 4 | | | |
| Vendor | Try 1 | Try 2 | Acct Sys | Try 1 | Try 2 | Marketing | Try 1 | Try 2 | Vertical | Try 1 | Try 2 | |
| Supply | Try 1 | Try 2 | IT Sys | Try 1 | Try 2 | Operations | Try 1 | Try 2 | Alliance | Try 1 | Try 2 | |
| Inventory | Try 1 | Try 2 | Recruiting | Try 1 | Try 2 | Low Cost | Try 1 | Try 2 | Global | Try 1 | Try 2 | |
| Customer | Try 1 | Try 2 | Training | Try 1 | Try 2 | Soc Media | Try 1 | Try 2 | Diversify | Try 1 | Try 2 | |
| Communicate | Try 1 | Try 2 | Reward | Try 1 | Try 2 | Innovation | Try 1 | Try 2 | Canvas | Try 1 | Try 2 | |
| Finanacial | Try 1 | Try 2 | Governance | Try 1 | Try 2 | Diff Strat | Try 1 | Try 2 | Acquisition | Try 1 | Try 2 | |
| Bonus 1 | | | Bonus 1 | | | Bonus 1 | | | Bonus 1 | | | |
| Stage 1 | | | Stage 2 | | | Stage 4 | | | Stage 4 | | | |
| Bonus 2 | | | Bonus 2 | | | Bonus 2 | | | Bonus 2 | | | |
| Stage 1 | | | Stage 2 | | | Stage 4 | | | Stage 4 | | | |

FIG.23

Game Board For Team 3 Activity

BiggieBills$$$ TEAM THREE

| Completed Growth Cards | | | | | | | | | | | | Active Card this Turn |
|---|---|---|---|---|---|---|---|---|---|---|---|---|
| Stage 1 | | | Stage 2 | | | Stage 3 | | | Stage 4 | | | |
| Vendor | Try 1 | Try 2 | Acct Sys | Try 1 | Try 2 | Marketing | Try 1 | Try 2 | Vertical | Try 1 | Try 2 | |
| Supply | Try 1 | Try 2 | IT Sys | Try 1 | Try 2 | Operations | Try 1 | Try 2 | Alliance | Try 1 | Try 2 | |
| Inventory | Try 1 | Try 2 | Recruiting | Try 1 | Try 2 | Low Cost | Try 1 | Try 2 | Global | Try 1 | Try 2 | |
| Customer | Try 1 | Try 2 | Training | Try 1 | Try 2 | Soc Media | Try 1 | Try 2 | Diversify | Try 1 | Try 2 | |
| Communicate | Try 1 | Try 2 | Reward | Try 1 | Try 2 | Innovation | Try 1 | Try 2 | Canvas | Try 1 | Try 2 | |
| Finanacial | Try 1 | Try 2 | Governance | Try 1 | Try 2 | Diff Strat | Try 1 | Try 2 | Acquisition | Try 1 | Try 2 | |
| Bonus 1 | | | Bonus 1 | | | Bonus 1 | | | Bonus 1 | | | |
| Stage 1 | | | Stage 2 | | | Stage 4 | | | Stage 4 | | | |
| Bonus 2 | | | Bonus 2 | | | Bonus 2 | | | Bonus 2 | | | |
| Stage 1 | | | Stage 2 | | | Stage 4 | | | Stage 4 | | | |

FIG.24

Game Board For Team 4 Activity

BiggieBills$$$ TEAM FOUR

| Completed Growth Cards | | | | | | | | | | | | Active Card this Turn |
|---|---|---|---|---|---|---|---|---|---|---|---|---|
| Stage 1 | | | Stage 2 | | | Stage 3 | | | Stage 4 | | | |
| Vendor | Try 1 | Try 2 | Acct Sys | Try 1 | Try 2 | Marketing | Try 1 | Try 2 | Vertical | Try 1 | Try 2 | |
| Supply | Try 1 | Try 2 | IT Sys | Try 1 | Try 2 | Operations | Try 1 | Try 2 | Alliance | Try 1 | Try 2 | |
| Inventory | Try 1 | Try 2 | Recruiting | Try 1 | Try 2 | Low Cost | Try 1 | Try 2 | Global | Try 1 | Try 2 | |
| Customer | Try 1 | Try 2 | Training | Try 1 | Try 2 | Soc Media | Try 1 | Try 2 | Diversify | Try 1 | Try 2 | |
| Communicate | Try 1 | Try 2 | Reward | Try 1 | Try 2 | Innovation | Try 1 | Try 2 | Canvas | Try 1 | Try 2 | |
| Finanacial | Try 1 | Try 2 | Governance | Try 1 | Try 2 | Diff Strat | Try 1 | Try 2 | Acquisition | Try 1 | Try 2 | |
| Bonus 1 | | | Bonus 1 | | | Bonus 1 | | | Bonus 1 | | | |
| Stage 1 | | | Stage 2 | | | Stage 4 | | | Stage 4 | | | |
| Bonus 2 | | | Bonus 2 | | | Bonus 2 | | | Bonus 2 | | | |
| Stage 1 | | | Stage 2 | | | Stage 4 | | | Stage 4 | | | |

FIG.25

Game Board For Team 5 Activity

BiggieBills$$$ TEAM FIVE

| Completed Growth Cards | | | | | | | | | | | | Active Card this Turn |
|---|---|---|---|---|---|---|---|---|---|---|---|---|
| Stage 1 | | | Stage 2 | | | Stage 3 | | | Stage 4 | | | |
| Vendor | Try 1 | Try 2 | Acct Sys | Try 1 | Try 2 | Marketing | Try 1 | Try 2 | Vertical | Try 1 | Try 2 | |
| Supply | Try 1 | Try 2 | IT Sys | Try 1 | Try 2 | Operations | Try 1 | Try 2 | Alliance | Try 1 | Try 2 | |
| Inventory | Try 1 | Try 2 | Recruiting | Try 1 | Try 2 | Low Cost | Try 1 | Try 2 | Global | Try 1 | Try 2 | |
| Customer | Try 1 | Try 2 | Training | Try 1 | Try 2 | Soc Media | Try 1 | Try 2 | Diversify | Try 1 | Try 2 | |
| Communicate | Try 1 | Try 2 | Reward | Try 1 | Try 2 | Innovation | Try 1 | Try 2 | Canvas | Try 1 | Try 2 | |
| Finanacial | Try 1 | Try 2 | Governance | Try 1 | Try 2 | Diff Strat | Try 1 | Try 2 | Acquisition | Try 1 | Try 2 | |
| Bonus 1 | | | Bonus 1 | | | Bonus 1 | | | Bonus 1 | | | |
| Stage 1 | | | Stage 2 | | | Stage 4 | | | Stage 4 | | | |
| Bonus 2 | | | Bonus 2 | | | Bonus 2 | | | Bonus 2 | | | |
| Stage 1 | | | Stage 2 | | | Stage 4 | | | Stage 4 | | | |

FIG.26

Game Board For Team 6 Activity

BiggieBills$$$ TEAM SIX

| Completed Growth Cards | | | | | | | | | | | | Active Card this Turn |
|---|---|---|---|---|---|---|---|---|---|---|---|---|
| Stage 1 | | | Stage 2 | | | Stage 3 | | | Stage 4 | | | |
| Vendor | Try 1 | Try 2 | Acct Sys | Try 1 | Try 2 | Marketing | Try 1 | Try 2 | Vertical | Try 1 | Try 2 | |
| Supply | Try 1 | Try 2 | IT Sys | Try 1 | Try 2 | Operations | Try 1 | Try 2 | Alliance | Try 1 | Try 2 | |
| Inventory | Try 1 | Try 2 | Recruiting | Try 1 | Try 2 | Low Cost | Try 1 | Try 2 | Global | Try 1 | Try 2 | |
| Customer | Try 1 | Try 2 | Training | Try 1 | Try 2 | Soc Media | Try 1 | Try 2 | Diversify | Try 1 | Try 2 | |
| Communicate | Try 1 | Try 2 | Reward | Try 1 | Try 2 | Innovation | Try 1 | Try 2 | Canvas | Try 1 | Try 2 | |
| Finanacial | Try 1 | Try 2 | Governance | Try 1 | Try 2 | Diff Strat | Try 1 | Try 2 | Acquisition | Try 1 | Try 2 | |
| Bonus 1 | | | Bonus 1 | | | Bonus 1 | | | Bonus 1 | | | |
| Stage 1 | | | Stage 2 | | | Stage 4 | | | Stage 4 | | | |
| Bonus 2 | | | Bonus 2 | | | Bonus 2 | | | Bonus 2 | | | |
| Stage 1 | | | Stage 2 | | | Stage 4 | | | Stage 4 | | | |

FIG.27

Game Board For Team 7 Activity

BiggieBills$$$ TEAM SEVEN

| Completed Growth Cards | | | | | | | | | | | | Active Card this Turn |
|---|---|---|---|---|---|---|---|---|---|---|---|---|
| Stage 1 | | | Stage 2 | | | Stage 3 | | | Stage 4 | | | |
| Vendor | Try 1 | Try 2 | Acct Sys | Try 1 | Try 2 | Marketing | Try 1 | Try 2 | Vertical | Try 1 | Try 2 | |
| Supply | Try 1 | Try 2 | IT Sys | Try 1 | Try 2 | Operations | Try 1 | Try 2 | Alliance | Try 1 | Try 2 | |
| Inventory | Try 1 | Try 2 | Recruiting | Try 1 | Try 2 | Low Cost | Try 1 | Try 2 | Global | Try 1 | Try 2 | |
| Customer | Try 1 | Try 2 | Training | Try 1 | Try 2 | Soc Media | Try 1 | Try 2 | Diversify | Try 1 | Try 2 | |
| Communicate | Try 1 | Try 2 | Reward | Try 1 | Try 2 | Innovation | Try 1 | Try 2 | Canvas | Try 1 | Try 2 | |
| Finanacial | Try 1 | Try 2 | Governance | Try 1 | Try 2 | Diff Strat | Try 1 | Try 2 | Acquisition | Try 1 | Try 2 | |
| Bonus 1 | | | Bonus 1 | | | Bonus 1 | | | Bonus 1 | | | |
| Stage 1 | | | Stage 2 | | | Stage 4 | | | Stage 4 | | | |
| Bonus 2 | | | Bonus 2 | | | Bonus 2 | | | Bonus 2 | | | |
| Stage 1 | | | Stage 2 | | | Stage 4 | | | Stage 4 | | | |

FIG.28

Game Board For Team 8 Activity

BiggieBills$$$ TEAM EIGHT

| Completed Growth Cards | | | | | | | | | | | | Active Card this Turn |
|---|---|---|---|---|---|---|---|---|---|---|---|---|
| Stage 1 | | | Stage 2 | | | Stage 3 | | | Stage 4 | | | |
| Vendor | Try 1 | Try 2 | Acct Sys | Try 1 | Try 2 | Marketing | Try 1 | Try 2 | Vertical | Try 1 | Try 2 | |
| Supply | Try 1 | Try 2 | IT Sys | Try 1 | Try 2 | Operations | Try 1 | Try 2 | Alliance | Try 1 | Try 2 | |
| Inventory | Try 1 | Try 2 | Recruiting | Try 1 | Try 2 | Low Cost | Try 1 | Try 2 | Global | Try 1 | Try 2 | |
| Customer | Try 1 | Try 2 | Training | Try 1 | Try 2 | Soc Media | Try 1 | Try 2 | Diversify | Try 1 | Try 2 | |
| Communicate | Try 1 | Try 2 | Reward | Try 1 | Try 2 | Innovation | Try 1 | Try 2 | Canvas | Try 1 | Try 2 | |
| Finanacial | Try 1 | Try 2 | Governance | Try 1 | Try 2 | Diff Strat | Try 1 | Try 2 | Acquisition | Try 1 | Try 2 | |
| Bonus 1 | | | Bonus 1 | | | Bonus 1 | | | Bonus 1 | | | |
| Stage 1 | | | Stage 2 | | | Stage 4 | | | Stage 4 | | | |
| Bonus 2 | | | Bonus 2 | | | Bonus 2 | | | Bonus 2 | | | |
| Stage 1 | | | Stage 2 | | | Stage 4 | | | Stage 4 | | | |

Introduction to e-Banking Details

FIG.31

View of the Opening Panel e-Banking

Biggie Bill$$$$

A Strategy Game

When the game starts it should have the screen Display with the game logo and turns 1.1 and 1.2 And displayed without any numbers except 200, All rest should be displayed

| Turn | Team | Team 1 | Team 2 | Team 3 | Team 4 |
|---|---|---|---|---|---|
| 1.1 | Business Cycle 1.1 starts | 200 | 200 | 200 | 200 |
| | Resource cost for the active growth card | 0 | 0 | 0 | 0 |
| | **Total** | **200** | **200** | **200** | **200** |
| 1.2 | Business Cycle 1- New turn 1.2 starts | **200** | **200** | **200** | **200** |
| | Resource cost for the active growth card | 0 | 0 | 0 | 0 |
| | Payoff from the previous turn | 0 | 0 | 0 | 0 |
| | Action challenged by a team for an active growth card | 0 | 0 | 0 | 0 |
| | Action challenged by another team for the same active growth card | 0 | 0 | 0 | 0 |
| | Industry rule change (Not applicable this turn) | 0 | 0 | 0 | 0 |
| | **Total** | **200** | **200** | **200** | **200** |

FIG.32

View of the Second Panel e-Banking

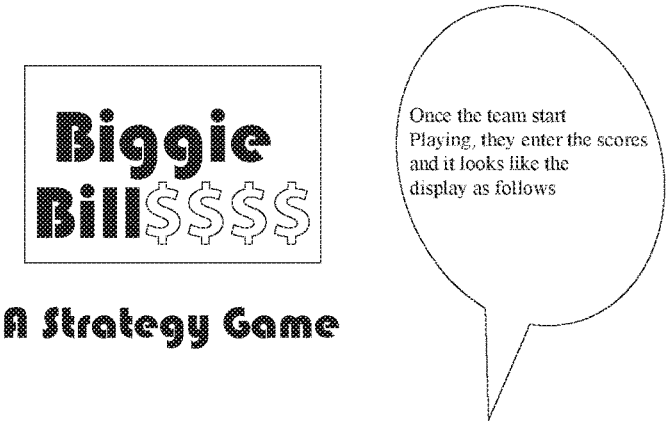

| Turn | Team | Team 1 | Team 2 | Team 3 | Team 4 |
|---|---|---|---|---|---|
| 1.1 | Business Cycle 1.1 starts | 200 | 200 | 200 | 200 |
| | Resource cost for the active growth card | -1 | -5 | -3 | -5 |
| | **Total** | **199** | **195** | **197** | **195** |
| 1.2 | Business Cycle 1- New turn 1.2 starts | **199** | **195** | **197** | **195** |
| | Resource cost for the active growth card | -3 | -15 | -6 | -5 |
| | Payoff from the previous turn | 6 | 59 | 0 | 0 |
| | Action challenged by a team for an active growth card | 11 | 33 | -33 | 14 |
| | Action challenged by another team for the same active growth card | 0 | 33 | -33 | 0 |
| | Industry rule change (Not applicable this turn) | 0 | 0 | 0 | 0 |
| | **Total** | **213** | **305** | **125** | **204** |

FIG.33

View of the e-Banking Score moving from Turn 1.1 to Turn 1.2

Once the team start
Playing, they enter the scores
And the total from 1.1
is then cut and paste to 1.2

Biggie Bill$$$$

A Strategy Game

Once the team start
Playing, they enter the scores
and it looks like the
display as follows

| Turn | Team | Team 1 | Team 2 | Team 3 | Team 4 |
|---|---|---|---|---|---|
| 1.1 | Business Cycle 1.1 starts | 200 | 200 | 200 | 200 |
| | Resource cost for the active growth card | -1 | -5 | -3 | -5 |
| | **Total** | **199** | **195** | **197** | **195** |
| 1.2 | Business Cycle 1 - New turn 1.2 starts | **199** | **195** | **197** | **195** |
| | Resource cost for the active growth card | -3 | -15 | -6 | -5 |
| | Payoff from the previous turn | 6 | 59 | 0 | 0 |
| | Action challenged by a team for an active growth card | 11 | 33 | -33 | 14 |
| | Action challenged by another team for the same active growth card | 0 | 33 | -33 | 0 |
| | Industry rule change (Not applicable this turn) | 0 | 0 | 0 | 0 |
| | **Total** | **213** | **305** | **125** | **204** |

FIG.34

View of the e-Banking Score moving from Business Cycle 1 to 2 and 2 to 3

Once the team start Playing, they enter the scores And the total from 2.1 is then cut and paste to 2.2

Biggie Bill$$$$

A Strategy Game

The idea is that as soon as 2.2 is over the app copies the total to starting point of 3.1 And so on - see my excel The addition formula has to be built in

| Turn | Team | Team 1 | Team 2 | Team 3 | Team 4 |
|---|---|---|---|---|---|
| 1.1 | Business Cycle 1.1 starts | 200 | 200 | 200 | 200 |
| | Resource cost for the active growth card | -1 | -5 | -3 | -5 |
| | **Total** | **199** | **195** | **197** | **195** |
| 1.2 | Business Cycle 1- New turn 1.2 starts | 199 | 195 | 197 | 195 |
| | Resource cost for the active growth card | -3 | -15 | -6 | -5 |
| | Payoff from the previous turn | 6 | 59 | 0 | 0 |
| | Action challenged by a team for an active growth card | 11 | 33 | -33 | 14 |
| | Action challenged by another team for the same active growth card | 0 | 33 | -33 | 0 |
| | Industry rule change (Not applicable this turn) | 0 | 0 | 0 | 0 |
| | **Total** | **213** | **305** | **125** | **204** |
| 2.1 | Business Cycle 2- New turn 2.1 starts | 213 | 305 | 125 | 204 |
| | Resource cost for the active growth card | -1 | -1 | -15 | -15 |
| | Payoff from the previous turn | 0 | 0 | 0 | 0 |
| | Action challenged by a team for an active growth card | 0 | 0 | 0 | 0 |
| | Action challenged by another team for the same active growth card | 0 | 0 | 0 | 0 |
| | Industry rule change (gain or loss) | 1 | 1 | 0 | 0 |
| | **Total** | **213** | **305** | **110** | **189** |
| 2.2 | Business Cycle 2- New turn 2.2 starts | 213 | 305 | 110 | 189 |
| | Resource cost for the active growth card | -15 | 0 | -1 | -10 |
| | Payoff from the previous turn | 0 | 0 | 0 | 33 |
| | Action challenged by a team for an active growth card | 0 | 30 | -30 | 0 |
| | Action challenged by another team for the same active growth card | 0 | 0 | 0 | 0 |
| | Industry rule change not applicable this turn | 0 | 0 | 0 | 0 |
| | **Total** | **198** | **335** | **79** | **212** |

3.1 should start here

BUSINESS STRATEGY GAME

RELATED APPLICATIONS

The present application claims priority to U.S. Provisional Patent Application No. 62/305,796 entitled "BUSINESS STRATEGY GAME," filed on Mar. 9, 2016 and the above application is incorporated herein by reference in its entirety.

FIELD OF THE INVENTION

The present invention is related to a tabletop game (board and cards) that provides an environment for training and teaching concepts from the strategy management subject. The game has a plurality of cards and a plurality of boards that allows either four or eight teams (consisting of up to four team members in each team) to play an interactive, real-time feedback, dynamic and interactive board game that in turn also explores the concepts developed in the field of Strategic Management that has grown tremendously both in business schools and corporate world. The game comes with a score keeping website so that participant can focus on playing the game and the moderator of the game manages the score. The name of this Business Strategy Game is BiggieBills.

BACKGROUND OF THE INVENTION

As the field strategic management has grown in the past six decades the tools to teach the concepts are limited for both students and managers. A review of academic literature finds that primarily this subject is taught using case studies of real businesses and there are very few experiential exercise or games available (Joshi et al., 2005). In recent years business schools have introduced new instructional methods and experiential exercises, and games to enhance the class room experience (Nulkar, 2016) because it has been argued that games improve student engagement because it may simulate the reality (Goltz and Hietapelto, 2011). Academics who have experimented with Gamification of the strategic management field find that it is useful to teach the basic tenets of the subject (Wallis and Wright, 2015). A detailed review of general gamification for teaching purpose found that it has positive impact on teaching and learning (Hamari et al., 2014). In fact it has been argued that in business context the market is ripe for Gamification (Dicheva et al., 2015) but there are not many business-themed games currently available to the students and the teachers or the trainers. In fact in an article at the Harvard Business Review, the author Andrew Innes argues that "Monopoly may be the world's favorite business-themed game, . . . but it's not necessarily the best one to hone your management skills or teach you what you need to win in business today" (HBR January-February 2015 page 118-119).

References used in above sections are listed here: a) Joshi et al., 2005, Experiential learning process: Exploring teaching and learning of strategic management framework through the winter survival exercise, Journal of Management Education, Volume 29 Issue 5, pages 672-695; b) Nulkar, G., 2016, Strategic Tangle: A Cocreated Strategy Game for Management Students, Management Teaching Review, Volume 1, Issue 2, pages 120-127; c) Goltz, S., and Hietapelto, A., 2011, Teaching across management disciplines with board games. Proceedings of the Organization Behavior Teaching Conference, pages 7-11; d) Wallis, S. E., and Wright, B., 2015, Strategic knowledge mapping: The co-creation of useful knowledge. Developments in business simulation and experiential learning, Volume 42 pages 1-18; e) Hamari, J., et al., 2014, Does gamification work? A literature review of empirical studies on gamification. Presented at the 47th Hawaii International Conference on System Sciences (HICSS), IEEE, pages 3025-3034; and f) Dicheva, D. et al., 2015, Gamification in Education: A Systematic Mapping Study, Educational Technology & Society, Volume 18, Issue 3, pages 75-88.

The search of Patents database finds that there have been some attempts to create tabletop games (board games or card games) that are training tools for a variety of subjects related to business. These include teaching value for money, U.S. Pat. No. 7,364,163 B1 (Savage); U.S. Pat. No. 4,354,684 A (McKinley) focusing on simulated business progress and business-related goals; U.S. Pat. No. 7,273,213 B2 (Gibbons et al.) that attempts to gauge the concepts of customer loyalty; U.S. Pat. No. 5,056,792 A (Helweg et al.) has a specific focus on financial topics such as assets, liabilities and future commitments of finance; U.S. Pat. No. 4,386,778 A (Hall) with a complete focus on teaching the rules and processes of construction industry and U.S. Pat. No. 6,237,915 B1 (Ledet et al.) that teaches project management skills.

The major weaknesses of these approaches pertain to the fact that the above-mentioned games, in the previous section, are focused on a very narrow scope of the subject matter. Additionally, none of these games directly focus on teaching a variety of topics from the strategy management field. Many of these games are played at individual level and therefore do not provide the opportunity for team building (a critical component of any corporate training). Many of these games are not generalizable to full spectrum of functions across a business enterprise and as such are ruled out to be a tool for annual strategic retreat of a firm. Given that strategic planning and strategy formation are most common topics in strategic retreats, there is a strong need among trainers to use hands on activities and experiential exercises or gamification of these topics to improving learning among participants. Unfortunately, the presently available games fall short on delivering these ideas easily.

Present invention has a valuable contribution because BiggieBills is interactive board game that allows for a dynamic real-time experience for the participants. Unlike other simulation strategy games available in the market place, the dynamic feedback loop and counter offensive in real time are its strength. The core learning comes from the debrief process by the instructor (moderator of the game) after the game is won by a team. This game covers many aspects of the current research in the field of strategic management such as resource based view of the firm, game theory, first mover advantage, competitive dynamics, competitive advantage, business level strategies such a low cost leadership and differentiation strategies, industry assessment, corporate level strategies such as strategic alliances, globalization and diversification. Finally, the customizability of industry conditions creates the possibilities for targeted learning topics and customizability is also applicable to the mode of playing the game. The game can be played "Face to Face" or "Online."

SUMMARY OF THE INVENTION

Present invention, BiggieBills, is an interactive business strategy game played by 4 teams of up to 4 to 6 members each (with a minimum of one player per team). The game may be adapted for up to 8 teams by doubling the number of game cards. Each team takes on the role of an established business trying to gain the top position in its defined industry. The teams play Growth Cards to progress across the Team Board from Stage 1 to Stage 4 while dealing with possible Challenge Cards played by opposing teams all the while dealing with random changes in Industry Rules with every Business Cycle. The standard game may last up to 3 hours.

The BiggieBills game is created with a three pronged learning approach: Corporate Training; Expanded Education; and Entertainment.

Corporate Training: The game is suitable for executive training and strategic retreats for businesses. The game can be used for executives at all levels of a business including senior management. The game is designed to be customized to suit a specific industry, if required. The debrief process by the game facilitator enhances learning through either the standard game or customized game. Either way, the participants of the game are introduced to the basic concepts of strategic management, strategic thinking, strategy formulation and strategy implementation.

Expanded Education: With some additional modifications, this game can deliver fundamental concepts related to additional business topics such as corporate entrepreneurship, intrapreneurship, innovation management, international business, new product development, marketing, entrepreneurship and more.

Entertainment: This game can be used as a fun filled entertaining game for family and friends.

GAME COMPONENTS: BiggieBills game has One Center Board and 4 (or 8) Team Boards (please see FIGS. 19 and 20). Additionally, four different types of cards are part of BiggieBills; Growth Cards, Challenge Cards; Industry Rules Cards, and Bonus Cards. In the following section each card is explained in detail.

GROWTH CARDS: Plurality of Growth Cards are present in the game and these cards are categorized from Stage 1 to Stage 4. Growth Cards are used to grow the firm and to progress across all 4 stages. To play a Growth Card teams must pay the cost listed on the card and this cost is deducted from the team's bank account. If a team cannot afford the cost to play a Growth Card, then the team will be prohibited from playing that specific growth card. The details of each Growth Card are found in FIGS. 1, 2, 3, and 4.

CHALLENGE CARDS: Plurality of Challenge Cards is present in the game corresponding to each growth card and these cards are played to challenge other team's Growth Cards. There is no cost to play a Challenge Card, however, playing a Challenge Card counts toward a team's turn. Any team may use their turn to challenge an active Growth Card played by another team. The details of each Challenge Card are found FIGS. 5, 6, 7, and 8.

INDUSTRY RULES CARDS: Plurality of Industry Rules Cards are present in the game and these cards provide the industry rules for each Business Cycle. These cards are not dealt to any team. However, Industry Rules Card is randomly drawn by the game moderator from the Center Board. The changes in the rules due to the Industry Card are announced and these changed rules are in effect for only one Business Cycle. At the start of the game, the first Business Cycle, no Industry Rules Card is drawn. Please see FIGS. 11, 12, 13, and 14.

BONUS CARDS: Plurality of Bonus Cards is present in the game and these cards are not dealt to any teams in the beginning of the game. Bonus Cards are earned by a team while playing the game. There are two types of Bonus Cards: Flexible Challenge Cards that Challenge any Growth Card (applicable to a specified Stage) and Block a Challenge cards that block a challenge to any Growth Card.

EARNING A BONUS CARD: When a team successfully completes three Growth Cards in any one stage, the team earns one Bonus Card. If a team completes a fourth Growth Card in the same stage, it can earn an additional Bonus Card. A team can earn only two Bonus Cards per stage. In total, a team can earn 8 Bonus Cards for the entirety of the game. The details of the Bonus Cards are provided in FIGS. 9 and 10.

GAME SCORE KEEPING: A Website based e-Bank tracks the bank balance of each team after every turn. The total for each team is displayed in the room via an overhead projector for all participants' knowledge in a "face to face" game whereas website will display bank balance to all participants when playing online. The e-Bank is managed by the facilitator of the game. Game moderator is required to mange this aspect of the game. Please see FIGS. 30-34 for details of e-Bank. Also, FIGS. 21-29 provide explanation concerning keeping track of activity by each team.

DESCRIPTION OF FIGURES

FIG. 1: Six Unique Growth Cards of Stage 1.
FIG. 2: Six Unique Growth Cards of Stage 2.
FIG. 3: Six Unique Growth Cards of Stage 3.
FIG. 4: Six Unique Growth Cards of Stage 4.
FIG. 5: Six Unique Challenge Cards of Stage 1 corresponding to Growth Cards.
FIG. 6: Six Unique Challenge Cards of Stage 2 corresponding to Growth Cards.
FIG. 7: Six Unique Challenge Cards of Stage 3 corresponding to Growth Cards.
FIG. 8: Six Unique Challenge Cards of Stage 4 corresponding to Growth Cards.
FIG. 9: Flexible Challenge Bonus Cards for Stage 1 and 2 as well as Stage 3 and 4.
FIG. 10: Bonus Cards that allow for Block a Challenge Card.
FIG. 11: Industry Rules Change Cards (Rules 1 through 6).
FIG. 12: Industry Rules Change Cards (Rules 7 through 12).
FIG. 13: Industry Rules Change Cards (Rules 13 through 18).
FIG. 14: Industry Rules Change Cards (Rules 19 through 24).
FIG. 21: Game Board For Team 1 Activity.
FIG. 22: Game Board For Team 2 Activity.
FIG. 23: Game Board For Team 3 Activity.
FIG. 24: Game Board For Team 4 Activity.
FIG. 25: Game Board For Team 5 Activity.
FIG. 26: Game Board For Team 6 Activity.
FIG. 27: Game Board For Team 7 Activity.
FIG. 28: Game Board For Team 8 Activity.
FIG. 31: View of the Opening Panel e-Banking.
FIG. 32: View of the Second Panel e-Banking.

FIG. 33: View of the e-Banking Score moving from Turn 1.1 to 1.2.

FIG. 34: View of the e-Banking Score moving from Business Cycle 1 to 2 and 2 to 3.

DETAILED DESCRIPTION OF THE INVENTION

Present invention, BiggieBills, facilitates an environment for corporate training, in class experiential teaching, or online experience to provide training in concepts drawn from the field of strategy management. The game has a plurality of cards and a plurality of boards that allows either four or eight teams (consisting of up to four team members in each team) to play an interactive, real-time feedback, dynamic and interactive board game (either face to face or online).

Figure 15:
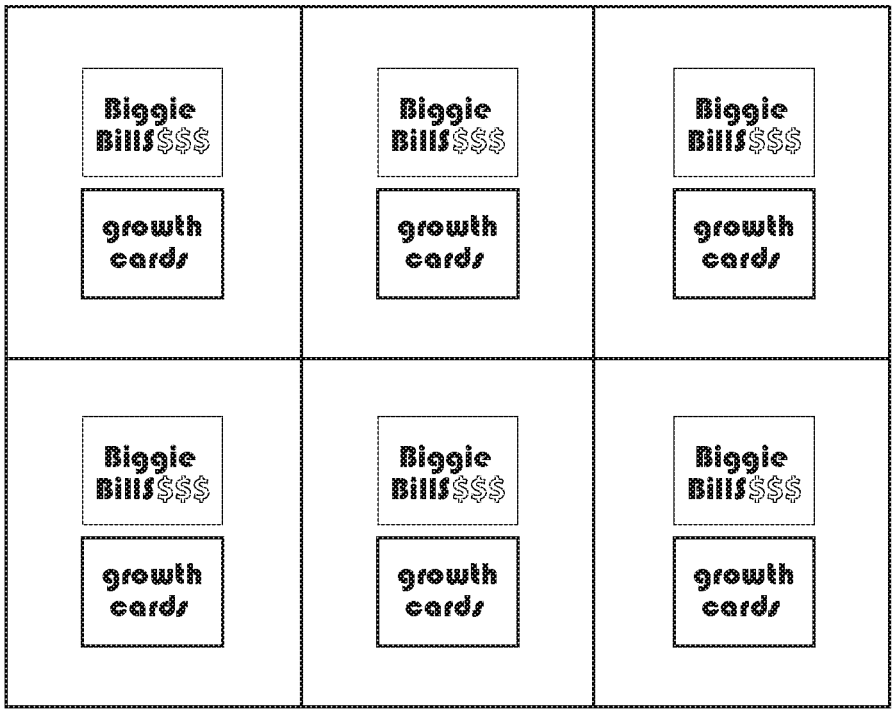
FIG. 15: Backside of the Growth Cards.
Figure 16:
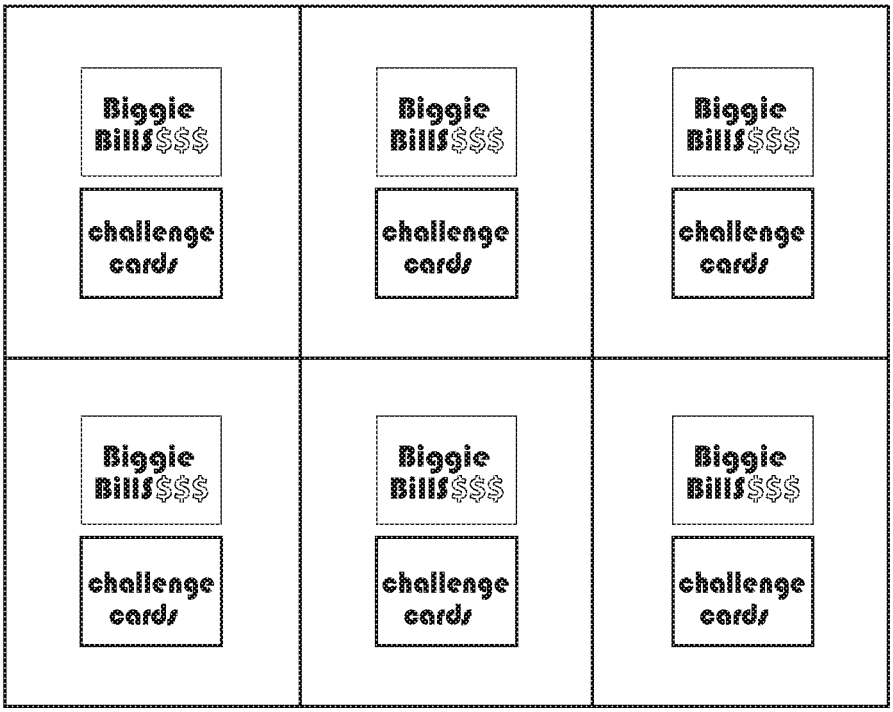
FIG. 16: Backside of the Challenge Cards.
Figure 17:
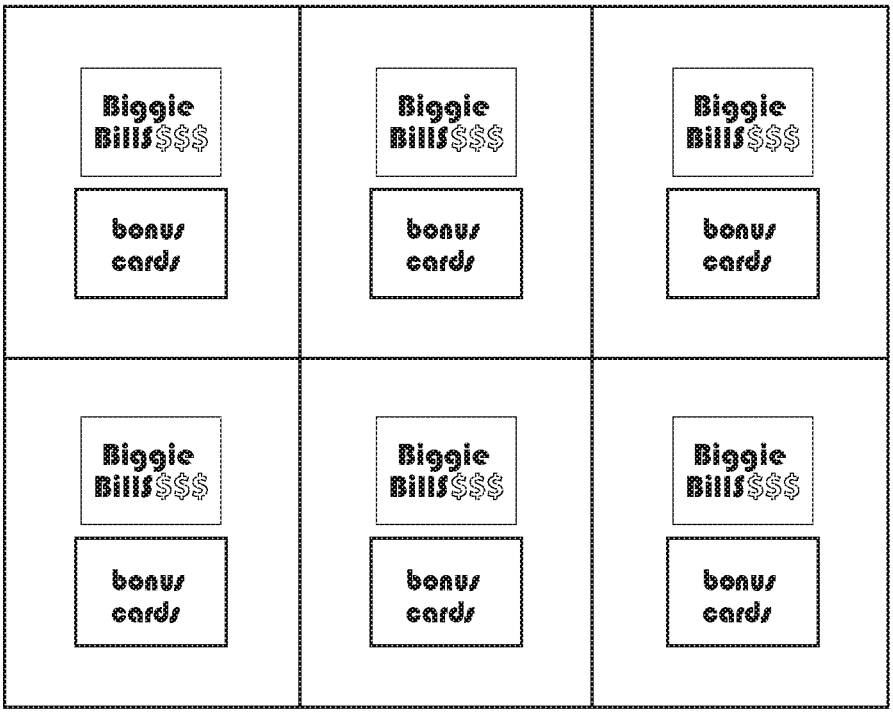
FIG. 17: Backside of the Bonus Cards.
Figure 18:
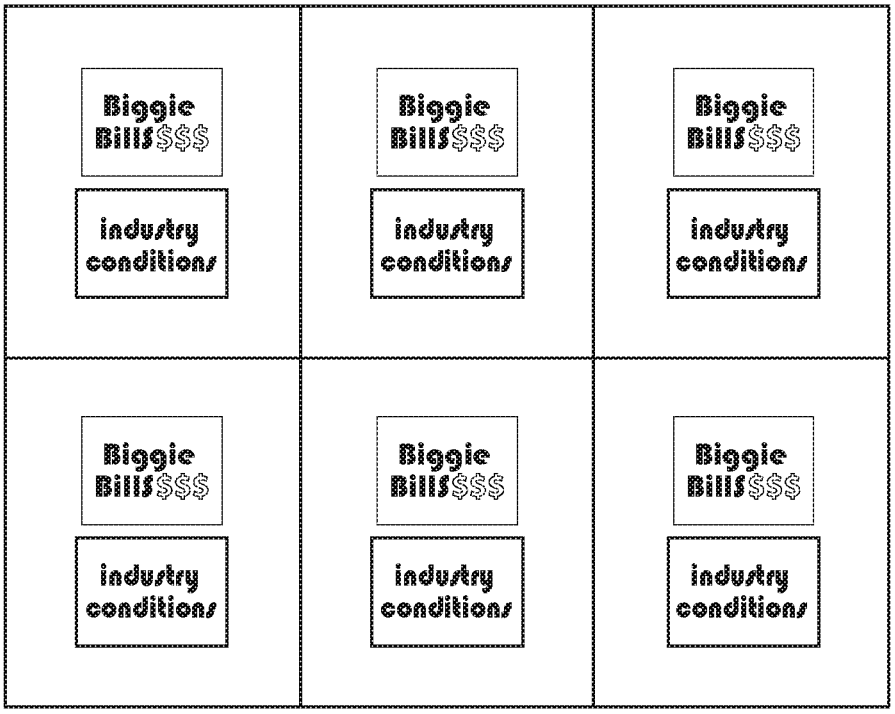
FIG. 18: Backside of the Industry Conditions (Industry Rules Change) Cards.
Figure 19:
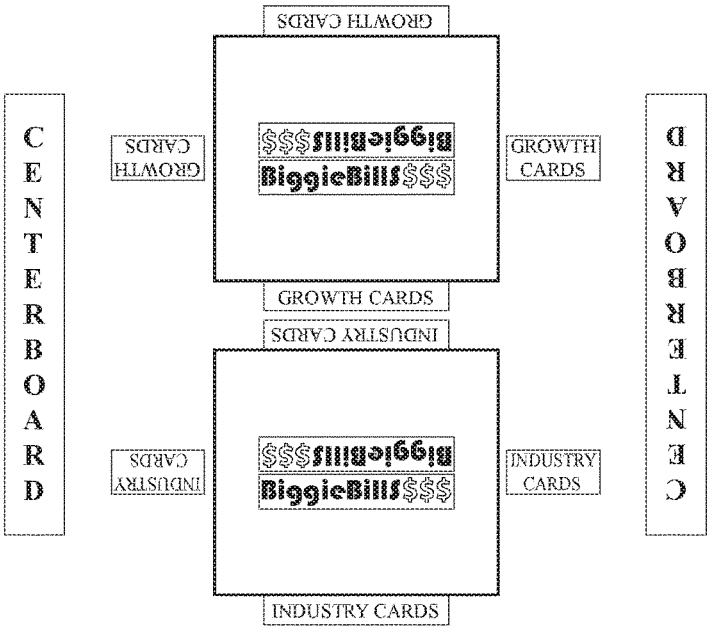
FIG. 19: Game Board with Spaces for Growth Card Deck and Industry Card Deck.
Figure 20:
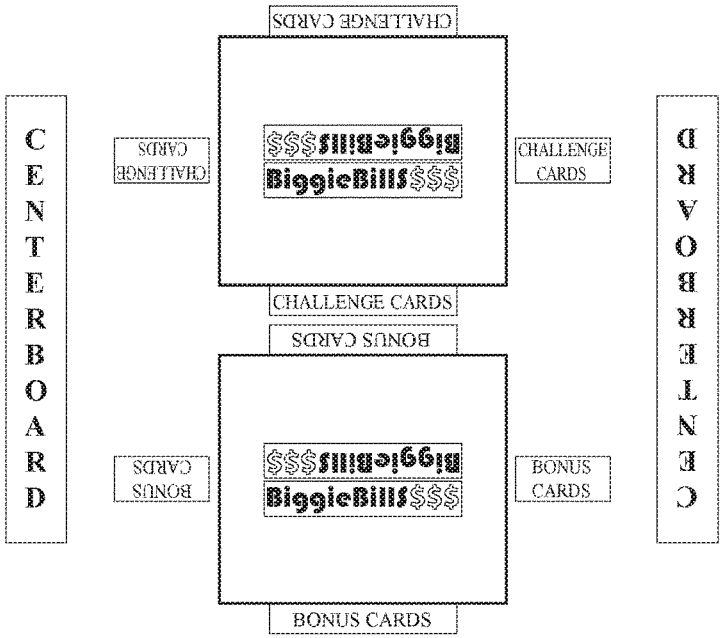
FIG. 20: Game Board with Spaces for Challenge Card Deck and Bonus Card Deck.
Figure 29:
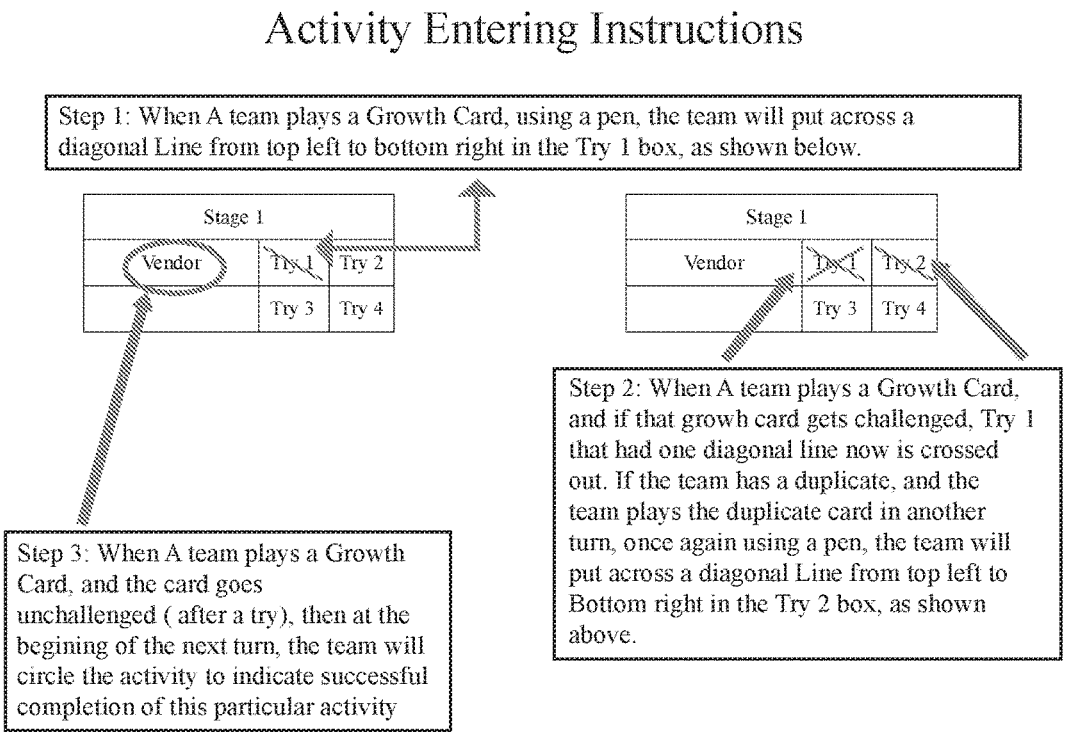
FIG. 29: Activity Entering Instructions.
Figure 30:
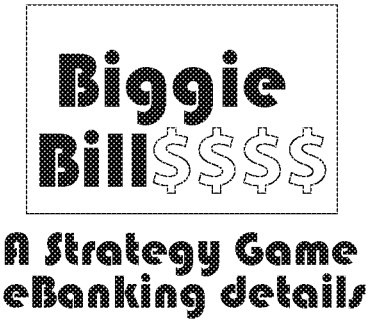
FIG. 30: Introduction to e-Banking Details.

BiggieBills game has One Center Board and 4 (or 8) Team Boards (please see FIGS. 19 and 20). Additionally, four different types of cards are part of BiggieBills; Growth Cards, Challenge Cards; Industry Rules Cards, and Bonus Cards.

SETTING UP THE GAME AT THE INITIAL PHASE: At this juncture four steps are followed. 1) Each team starts with $200 Million in their respective e-Bank accounts. e-Bank account access may be provided during the game via a website, and the bank is managed by the moderator of the game. 2) Set the Center Board in a location accessible to all teams, and place Growth Card; Challenge Card; Industry Rules Card and Bonus Card decks face down on the Center Board. 3) Each team is randomly dealt 6 Growth Cards and 4 Challenge Cards by the game moderator. These 10 cards form each team's starting hand, and are kept secret from other teams so as to not reveal each team's portfolio of cards to others, and finally 4) No Industry Rules Cards or Bonus Cards are dealt at this time to any team.

PLAYING A TURN: Throughout the game, teams attempt to progress through four Stages which represent the growth of their business entity. BiggieBills is played over a series of turns, in which each team will have an opportunity to select and play a card or multiple cards as per Industry Rules for that Business Cycle on the team board (please see FIG. 29 and FIGS. 21-28 for managing the Team Board). During their turn, each team may perform several actions as listed in the following sections.

PLAYING A GROWTH CARD: All teams must begin the game by playing a Stage 1 Growth Card. After successfully completing a Stage 1 Growth Card a team can then play a Growth Card from any stage as long as they have successfully completed at least one Growth Card from a previous stage. Having successfully completed a higher stage Growth Card, a team can go back to playing a lower stage Growth Card at any time in the game. A team can play a Growth Card by paying the cost of that Growth Card as listed on the card. When a team plays a Growth Card, it must draw another Growth Card from the Growth Card Deck on the Center Board. The details of each Growth Card are found in FIGS. 1, 2, 3, and 4.

PLAYING A CHALLENGE CARD: A team can play a Challenge Card as a first challenger if that team has the Challenge Card specific to an active Growth Card and is eligible by having completed a Growth Card of the same stage. When a team plays a Challenge Card, it must draw another Challenge Card from the Challenge Card Deck on the Center Board. If a team chooses to challenge a Growth Card played by another team it will lose its chance to play a Growth Card for that turn (unless of course industry rules allow to play two cards). Unsuccessful Challenge Cards: A Challenge Card is null and void if a Block the Challenge Card (Bonus Card) is played by the team that is being challenged (please see FIGS. 9 and 10 for details on Bonus Cards). In such an event, the Growth Card remains active and the challenging Team pays the penalty listed on the Challenge Card to the team that played the Block the Challenge Bonus Card. The details of each Challenge Card are found FIGS. 5, 6, 7, and 8.

EXCHANGE CARDS: If a team is unable to play a Growth or Challenges Card, it may choose to play a Bonus Card or exchange two cards from its possession by drawing two cards from the Center Board. The exchange of cards will cost the team $5 million and the process of exchange will be considered as the team's turn. If this action is selected, no other cards except for a Bonus Card can be played during the team's turn. A team may exchange any combination of Growth or Challenges Cards.

SKIP A TURN AND REMAIN INACTIVE: If a team selects this action, a penalty (a fine) of $10 million for being inactive is incurred.

PLAYING A BONUS CARD: There are two types of Bonus Cards: Flexible Challenge and Block a Challenge Bonus Card. The Flexible Challenge Bonus Card is used to challenge an active Growth Card that was played by another team and does not count towards the single card per turn limit. This means that if a team possesses a Flexible Challenge Bonus Card and the team must wait to play it during a turn, the team can still play another Growth Card or a Challenge Card in addition to this Flexible Challenge Bonus Card. A team may play the Flexible Challenge Bonus Card as a turn. If Industry Rules allow Two-card Play during a turn then a team can play two bonus cards along with two Growth/Challenge Cards. The Block a Challenge Bonus Card is used to "Block" a Challenge Card against only one challenge. This card can be used immediately and out of turn only by the team that is being challenged. No other team other than the team being challenged can use this bonus card. In such an event, the Growth Card remains active and the challenging team pays the penalty listed on the Challenge Card to the team that played the Block the Challenge Bonus Card.

DRAWING CARDS: After playing either a Growth Card or a Challenge Card as its turn, the team draws a replacement card from the respective deck on the Centerboard. Any played Bonus Cards are not replaced by drawing Bonus Cards, these have to be earned.

BUSINESS CYCLES: A Business Cycle consists of two turns for each team. For each new business cycle the game moderator highlights a new order of play for the teams via the e-bank function. At the beginning of each business cycle, the moderator will randomly choose an Industry Rule Card. The changes in the rules due to the chosen Industry Rule Card are announced and will remain are in effect for only one Business Cycle. At the beginning of each business cycle, teams will have a few minutes to trade cards with other teams. Teams may trade any number of cards for any number of the other team's cards, however no money can be exchanged between teams. When one business cycle ends any Growth Cards that are active on the game board for all teams are automatically considered to have been successfully completed. Teams in their next turn will collect the payoff related to these completed Growth Cards. No team in the new business cycle can challenge a Growth Card from the previous business cycle.

STAGES of BIGGIEBILLS: In order to progress from one stage to another, teams must have successfully completed one Growth Card in a lower stage prior to playing a Growth Card in a higher stage. A team may play Growth Cards of lower Stages even after successfully completing a Growth Card of a higher Stage. To earn a Bonus Card, a team need not play its Growth Cards in any one stage in successive order. Instead, the cards can be played intermittently as described above in the description of stages.

MANAGING DUPLICATE CARDS: Possession of Duplicate Growth Cards is likely in the game. A team may hold on to the duplicate card to deny another team a chance to compete with this particular Growth Card or trade it or exchange it from the Center Board Deck of Growth Cards. Similarly Teams may possess duplicate Challenge Cards. Essentially, the duplicate Challenge cards of the same type are useful (and not rendered useless) when appropriate to challenge any other teams. A team may choose to trade it or exchange it from the Center Board Deck of Challenge Cards or retain it so that other teams are prevented to use it.

ACQUIRING A COMPETITOR: A team who has progressed to Stage 4 has the possibility of acquiring another team through a Growth Card called "Acquire a Competitor." Note that just like any other Growth Card, this card can be used successfully only once. Once the "Acquire a Competitor" Growth Card has been played, it is treated like any other Growth Card. Any other team may use a Challenge Card to stop this acquisition, if eligible to do so. If the Challenge Card is used then the acquiring team can use Block the Challenge Bonus Card, if they have one. This block Bonus card can be used to block only one challenge. If no challenges are issued, the acquiring team will receive the payout and complete acquisition of the target team on their next turn. If successfully played, the playing team acquires the target team, and the target team is out of the game (Target team loses). The acquiring team receives 25% of the target team's e-Bank cash and all the Growth Cards, Challenge Cards, and Bonus Cards.

WINNING THE GAME: There are 4 ways a team is declared the winner of BiggieBills; a) When any one team accumulates a total of One Billion Dollars, the game ends and that team wins the game. If all team players agree, the target dollar amount can be changed (e.g. Two Billion Dollars). However, such a target may extend the time of play; OR b) When only one team remains (all other teams have declared bankruptcy), the game ends. The surviving team is the winner, even if the surviving team has not reached One Billion Dollars; OR c) in the rare event when two teams reach the goal of One Billion Dollars simultaneously, the team with the most money is declared the winner. In the event the two teams have the same amount of money, the team with the highest number of completed Growth Cards wins; OR d) when playing with time limits, the team with the most money wins at the end of the set time. If two teams have the same amount of money, the team with the highest number of completed Growth Cards wins.

Uses Thereof:

The use as described earlier is focused on corporate training as well as preparing undergraduate and graduate students with respect to the concepts related to strategic management. More detailed uses are listed below.

BiggieBills can also deliver Concepts concerning: Mission, Vision, Goals and Values of a Corporation.

BiggieBills can also deliver Concepts concerning: Decision Making Skills imparted to Managers.

BiggieBills can also deliver Concepts concerning: Assessment and Management of External Environment.

BiggieBills can also deliver Concepts concerning: Competitive Environment including steps towards Competitive Intelligence.

BiggieBills can also deliver Concepts concerning: Value and Impact of Merger and Acquisitions.

BiggieBills can also deliver Concepts concerning: Cost and Benefits of Risk Taking.

BiggieBills can also deliver Concepts concerning: Managing Resources and Capabilities of a Firm and building of Core Competencies.

BiggieBills can also deliver Concepts concerning: Value of Strategic Alliances and Collaboration.

BiggieBills can also deliver Concepts concerning: Dealing with Unexpected Environmental Changes both Positive and Negative.

BiggieBills can also deliver Concepts concerning: Tracking the Behavior of a Firm's Closet Competitors.

BiggieBills can also deliver Concepts concerning: Cash Flow Management.

BiggieBills can also deliver Concepts concerning: Porter's Five Forces of Industry Analysis Framework BiggieBills can also deliver Concepts concerning: Meaning and Differences among BiggieBills can also deliver Concepts concerning: Functional Strategy, Business Level Strategy and Corporate Level Strategy.

BiggieBills can also deliver Concepts concerning: Relative Strategic Position.

BiggieBills can also deliver Concepts concerning: Focus on Corporate Governance and Structure.

BiggieBills can also deliver Concepts concerning: Benefits and Costs of First Mover Versus Late Mover.

BiggieBills can also deliver Concepts concerning: Strategy Implementation as a follow up to Strategy Formulation.

BiggieBills can also deliver Concepts concerning: Static Strategy Versus Dynamic Strategy.

BiggieBills can also deliver Concepts concerning: Management of Growth through understanding of Organizational Processes and Systems.

BiggieBills can also deliver Concepts concerning: Concept of Path Dependency towards Strategic Decision Making.

BiggieBills can also deliver Concepts concerning: Concept of Value Chain Analysis.

BiggieBills can also deliver Concepts concerning: Customized approach to adopt teaching in other business related subjects such as innovation management, corporate entrepreneurship, entrepreneurship, global strategy, economics, and Marketing.

BiggieBills can also deliver Concepts concerning: General skills of Observation and Problem Solving.

BiggieBills can also deliver Concepts concerning: Focus, Concentration and Memory Skills.

BiggieBills can also deliver Concepts concerning: Reflection skills.

BiggieBills can also deliver Concepts concerning: Negotiation Skills.

BiggieBills can also deliver Concepts concerning: Team building and Icebreaker exercise.

INCORPORATION BY REFERENCE

All patents, application and publications referred to in this application are incorporated herein by reference in their entirety.

What is claimed is:

1. A game played by a plurality of teams, with one or more players in each of the plurality of teams, and each of the plurality of teams doing a business trying to gain a top position in an industry by progressing through a plurality of stages of growth of the business in the industry, the game comprising:

a centerboard comprising a plurality of defined areas thereon including: a first indicia thereon defining a first area indicating a first placement of a plurality of growth cards, a second indicia thereon defining a second area indicating a second placement of a plurality of challenge cards, a third indicia thereon defining a third area indicating a third placement of a plurality of industry rules cards and a fourth indicia thereon defining a fourth area indicating a fourth placement of a plurality of bonus cards;

a plurality of team boards, one team board for each team, each of the plurality of team boards comprising a team board indicia thereon defining a plurality of spaces representing the plurality of growth cards in a plurality of growth stages, each of the plurality of spaces further comprising a box for keeping track of the plurality of growth cards that have been played, staved active and unchallenged by marking the box with a first mark, and for keeping track of the plurality of growth cards that have been played and/or challenged by a corresponding challenge card by marking the box with a second mark;

the plurality of growth cards comprising:

a plurality of process growth cards, each of the plurality of process growth cards comprising a process growth related indicia thereon, each of the process growth related indicia comprising a monetary cost indicia thereon defining a monetary cost for one of the plurality of teams to play one of the plurality of process growth cards, a monetary payoff indicia thereon indicating a monetary payoff amount one of the plurality of teams receives if one of the plurality of process growth cards remains unchallenged, and a monetary loss indicia thereon indicating a monetary loss one of the plurality of teams must absorb if one of the plurality of process growth cards is challenged, a plurality of system growth cards, each of the plurality of system growth cards comprising a system growth related indicia thereon, each of the system growth related indicia comprising a monetary cost indicia thereon defining a monetary cost for one of the plurality of teams to play one of the plurality of system growth cards, defining a monetary payoff indicia thereon indicating a monetary payoff amount one of the plurality of teams receives if one of the plurality of system growth cards remains unchallenged, and a monetary loss indicia thereon indicating a monetary loss one of the plurality of teams must absorb if one of the plurality of system growth cards is challenged;

a plurality of strategy growth cards, each of the plurality of strategy growth cards comprising a strategy growth related indicia thereon, each of a strategy growth related indicia comprising a monetary cost indicia thereon defining the monetary cost for one of the plurality of teams to play one of the plurality of strategy growth cards, defining a monetary payoff indicia thereon indicating a monetary payoff amount one of the plurality of teams receives if one of the plurality of strategy growth cards remains unchallenged, and a monetary loss indicia thereon indicating a monetary loss one of the plurality of teams must absorb if one of the plurality of strategy growth cards is challenged, the plurality of challenge cards comprising:

a plurality of process challenge cards, each of the plurality of process challenge cards comprising a process challenge related indicia thereon comprising a monetary payoff indicia thereon indicating a monetary payoff amount one of the plurality of teams receives if one of the plurality of process challenge cards is played, a plurality of system challenge cards, each of the plurality of system challenge cards comprising a system challenge related indicia thereon comprising a monetary payoff indicia thereon indicating a monetary payoff amount one of the plurality of teams receives if one of the plurality of system challenge cards is played;

a plurality of strategy challenge cards, each of the plurality of strategy challenge cards comprising a strategy challenge related indicia thereon comprising a monetary payoff indicia thereon indicating a monetary payoff amount one of the plurality of teams receives if one of the plurality of strategy challenge cards is played;

a plurality of industry rules cards comprising:

a first plurality of industry rules change cards, each of the first plurality of industry rules change cards comprising an industry rule change related indicia thereon listing a plurality of specific type of growth cards, and indicating a monetary amount to be gained by one of the plurality of teams if any of the plurality of specific type of growth cards listed thereon have been played by one of the plurality of teams, remains active and unchallenged, a second plurality of industry rule change cards, each second plurality of industry rules change cards comprising an industry rule change related indicia thereon listing a plurality of second specific type of growth cards, and indicating a monetary amount to be absorbed by one of the plurality of teams if any of the plurality of specific type of growth cards listed thereon are not as yet played by one of the plurality of teams, the plurality of bonus cards comprising:

a plurality of challenge blocking bonus cards, each of the plurality of challenge blocking bonus cards including first bonus related indicia allowing one of the plurality of teams to block a given challenge when a certain growth card played by one of the plurality of teams is challenged by a corresponding challenge card of another team keeping the certain growth card as an active growth card;

a plurality of flexible challenge bonus cards, each flexible challenge bonus card including a second bonus related indicia allowing one of the plurality of teams to challenge the active growth card of a specific stage played by another team; and a system for game score keeping comprising a bank balance for each of the plurality of teams, each bank balance having an amount of money therein.

2. The game of claim 1, wherein the plurality of strategy growth cards comprise a plurality of general strategy growth cards and a plurality of corporate strategy growth cards.

* * * * *